US005575049A

United States Patent [19]

Gorrafa et al.

[11] Patent Number: 5,575,049

[45] Date of Patent: Nov. 19, 1996

[54] YARN TEXTURING JET WITH IMPROVED ASSEMBLY AND DISASSEMBLY FEATURES

[75] Inventors: Adly A. Gorrafa; Jagdish N. Shah, both of Hockessin, Del.

[73] Assignee: E. I. Du Pont de Nemours and Company, Wilmington, Del.

[21] Appl. No.: 520,421

[22] Filed: Aug. 29, 1995

[51] Int. Cl.[6] ..... D02G 1/16

[52] U.S. Cl. ..... 28/272; 28/271

[58] Field of Search ..... 28/254, 255, 271, 28/272, 273, 274, 275, 276

[56] References Cited

U.S. PATENT DOCUMENTS

| | | | |
|---|---|---|---|
| 3,372,446 | 3/1968 | Shichman et al. | 28/1 |
| 3,545,057 | 12/1970 | Lubach | 28/1.4 |
| 3,863,309 | 2/1975 | Price | 28/1.4 |
| 4,041,583 | 8/1977 | Hart et al. | 28/254 |
| 4,095,319 | 6/1978 | Nelson | 28/273 |
| 4,099,308 | 7/1978 | Wesley | 28/273 |
| 4,157,605 | 6/1979 | Agers | 28/254 |
| 4,189,812 | 2/1980 | Agers et al. | 28/272 |
| 4,282,637 | 8/1981 | Mosseri et al. | 28/254 |
| 4,507,833 | 4/1985 | Simmen | 28/254 |
| 5,140,729 | 8/1992 | Simmen | 28/271 |
| 5,231,743 | 8/1993 | Goldstein | 28/272 |
| 5,241,730 | 9/1993 | Simmen et al. | 28/273 |

*Primary Examiner*—C. D. Crowder
*Assistant Examiner*—Larry D. Worrell, Jr.

[57] ABSTRACT

A self stringing jet for air texturing yarn having a yarn needle slidably mounted in the jet body for movement from a preset operating position to a string-up position. The yarn needle may be removed for inspection without disturbing the appropriate operating position by attaching a flange located outside the jet body to the yarn needle in a manner to engage means for stopping slidable movement of the yarn needle in the operating position. The flange is rotatable from engagement with means for stopping slidable movement of the yarn needle to permit the yarn needle to be moved axially out from the body without disturbing the means for stopping the yarn guiding member or without further rotation; the means for stopping slidable movement of the yarn needle is resettable to various positions to handle texturing of various yarn sizes.

4 Claims, 3 Drawing Sheets

YARN TEXTURING JET WITH IMPROVED ASSEMBLY AND DISASSEMBLY FEATURES

BACKGROUND OF THE INVENTION

This invention relates to air texturing of yarn and more particularly, to improvements in an air jet apparatus used to texture yarn.

Fluid jet apparatus for texturing yarn usually comprises a conically tipped yarn guiding tube or needle for introducing yarn into the apparatus, a port for supplying pressurized fluid to a space surrounding the forward end of the needle, and a venturi-shaped nozzle through which yarn and fluid leave the jet body. Yarn is usually introduced into such a jet by moving the forward end of the yarn needle very close to the converging entrance of the nozzle so that the velocity of flow of pressurized fluid is significantly increased between the two, producing an air pressure less than atmospheric at the forward end of the needle. This induces an inward flow of atmospheric air through the needle which will draw an end of yarn into and through the jet. This aspirating (string-up) position, however, generally does not permit sufficient fluid to pass through the jet to give optimum yarn texturing action. Therefore, the gap between the forward end of the yarn needle and the nozzle entrance is usually increased, i.e., the needle is moved back to some appropriate operating position, to provide optimum yarn texturing action. For consistent yarn quality, it is important that the appropriate operative position be maintained at all times.

These jets, when in use, are periodically inspected or replaced by removing the yarn needle from the jet body. This invention allows the jet needle to be removed and replaced without disturbing the preset operating position thus saving time and maintaining consistency when conducting this procedure over similar type air texturing jets of the prior art such as disclosed in U.S. Pat. No. 4,041,583, which is incorporated herein by reference.

SUMMARY OF THE INVENTION

The yarn texturing jet includes a hollow body member forming a chamber, means for introducing fluid under pressure into said chamber, an exit nozzle from the chamber for fluid and yarn and a yarn guiding tube axially slidable and rotatably twistable in the body member extending through the chamber for supplying yarn to the nozzle for texturing, the yarn guiding member is mounted in said body member for movement from an operating position to a string-up position closer to the exit nozzle and for movement back to an operating position and means for stopping movement of the yarn guiding member at a preset operating position. The improvement comprises a flange located outside said body member, the flange is attached to the yarn guiding member. The flange engages the means for stopping slidable movement of the yarn guiding tube in the operating position, and being rotatable free from engagement with the means for stopping slidable movement of the yarn guiding tube to permit the yarn guiding tube to be removed from the body member for examination or replacement without disturbing said means for stopping slidable movement said yarn guiding member.

A spring is attached to the body member which engages a notch on the flange to provide rotational positioning of said yarn guiding member within the body member.

The means for stopping slidable movement of the yarn guiding member is an adjustable stop member set to preset operating conditions for different yarns.

DETAILED DESCRIPTION OF THE PREFERRED EMBODIMENT

Figure 1:
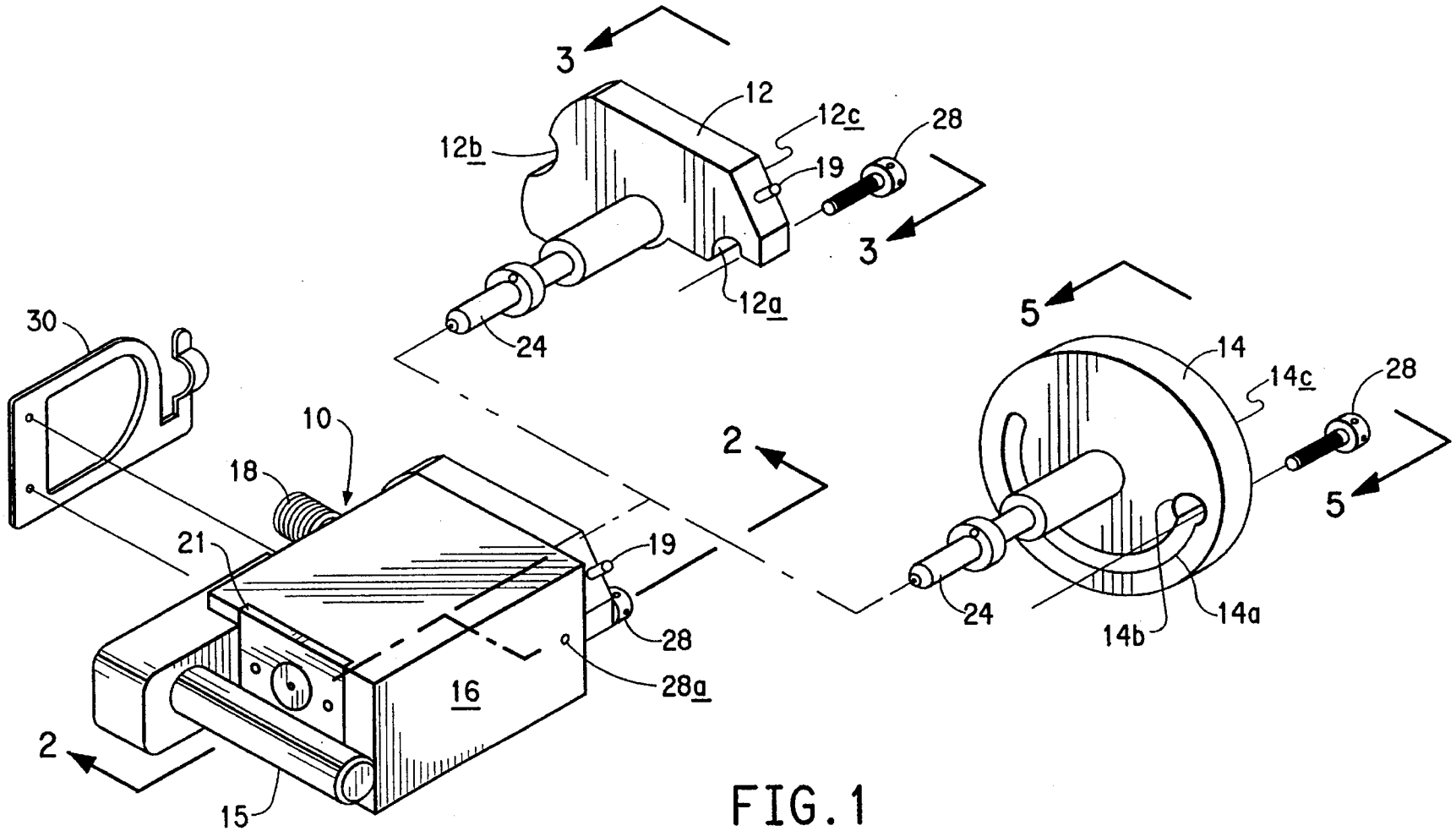
FIG. 1 is a perspective broken away view of a common yarn texturing jet with different yarn needle/ flange arrangements.
Figure 2:
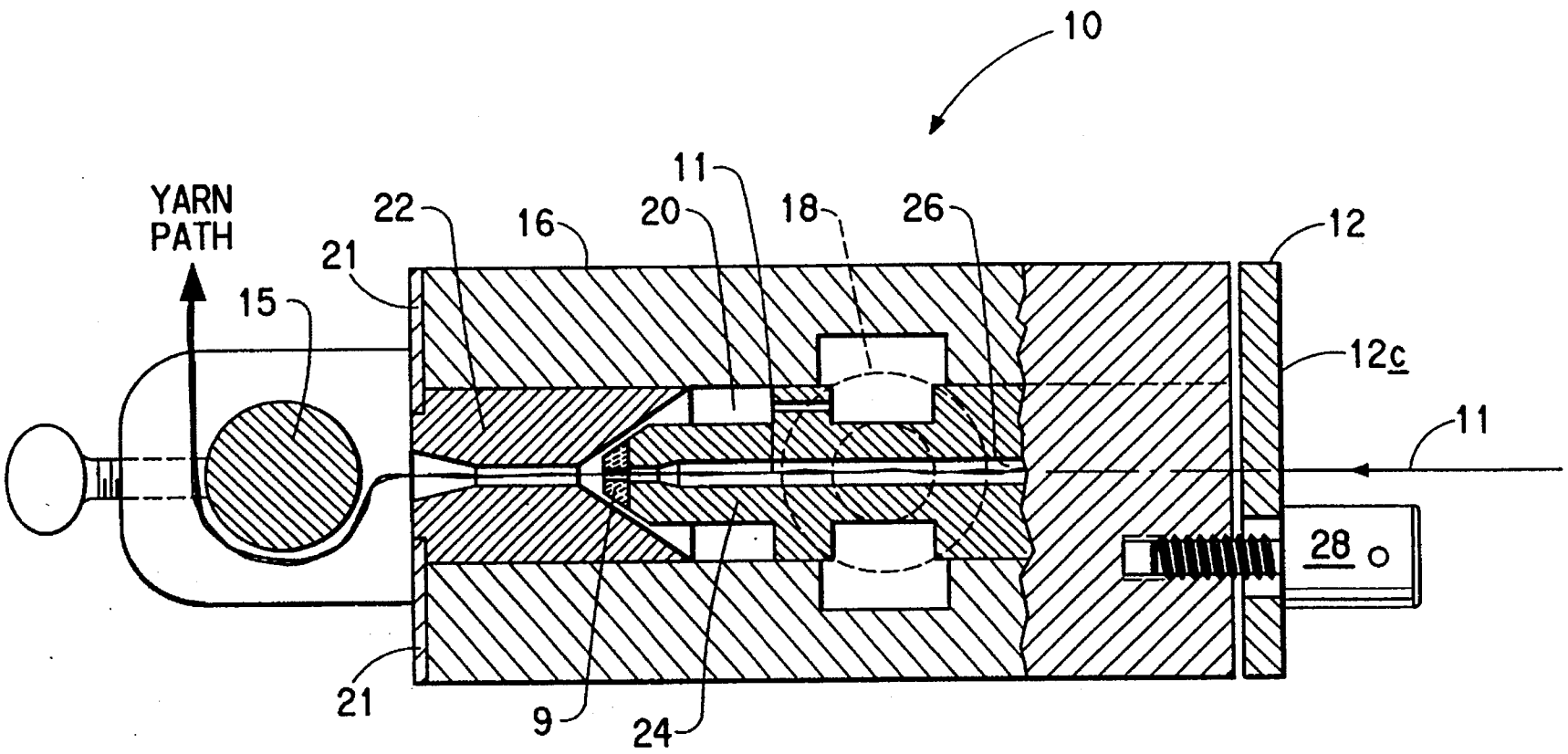
FIG. 2 is an enlarged section view of FIG. 1 taken along line 2—2.
Figure 3:
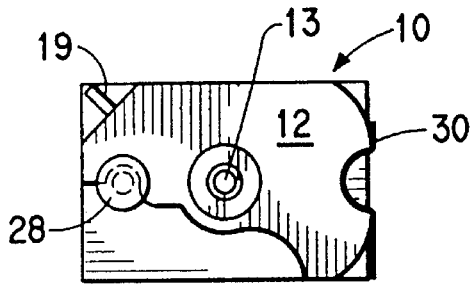
FIG. 3 is a view of FIG. 1 taken along line 3—3.

Referring to the drawing, a common yarn air texturing jet 10 is shown in FIG. 1 with two possible flange arrangements 12, 14 at its inlet end. The jet 10 includes as components a hollow body member 16, air inlet 18 leading into the bore 20 intermediate its ends. A baffle 15 in the form of a cylindrical bar is located at the outlet end of the jet body. The baffle is shown located centrally opposite the central axis of the body member 16. Other arrangements with the baffle offset from the central axis of the jet are known from the prior art. A flange 12 or 14 is located outside the body 16 at the yarn inlet end of the jet body. A venturi 22 is located in the bore 20 at the outlet end of the body. Venturi 22 is fabricated with a stepped down exit end diameter. An exit face plate 21 with a hole diameter matched to the venturi stepped down exit diameter is attached to the exit end of the jet body (FIGS. 1 and 2). In the operating mode, high pressure gas keeps the venturi 22 pressed against the exit face plate 21. A yarn guiding element 24 (commonly referred to as a yarn needle in the trade) is fixed to flange 12 or 14 and has a passage 26 therethrough for guiding yarn 11 from yarn inlet 13 of the jet past the gas inlet 18 through the exit end 9 of the yarn needle to the venturi 22.

Flange 12 as best shown in FIGS. 1, 2, 3, and 4 is shaped to have an open ended notch 12*a* on one edge and another open ended notch 12*b* on another edge of the flange. Notch 12*a* rotatably engages and disengages freely from bolt 28 while in the same rotatable movement notch 12*b* engages and disengages from spring 30 fastened to the side of jet 10. The notch 12*b* and spring 30 provide for rotational positioning of the yarn needle in the jet. Other rotational positioning means may be employed, such as a spring loaded ball or peg affixed to the body 16 and suitably mated with appropriate indentations in flange 12. Bolt 28 threads into body 16 and set screw 28*a* locks bolt 28 in position. Its head abuts against the outside surface 12*c* of flange 12 to serve as a stop for the movement of yarn needle 24 out of bore 20, i.e., serves as a means for limiting the slidable movement of flange 12 away from the inlet end of the body. The size of the head of bolt 28 is larger than the notch 12*a* in flange 12.

Figure 4:
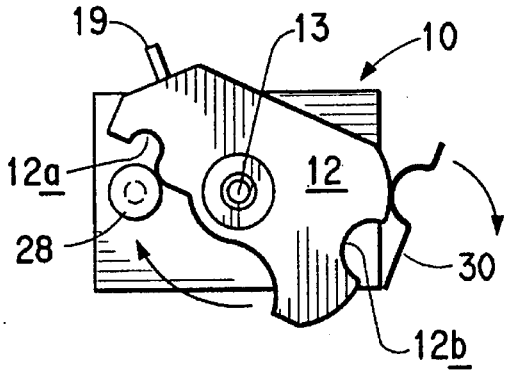
FIG. 4 is a view of FIG. 3 showing the flange rotated beyond the stop.
Figure 6:
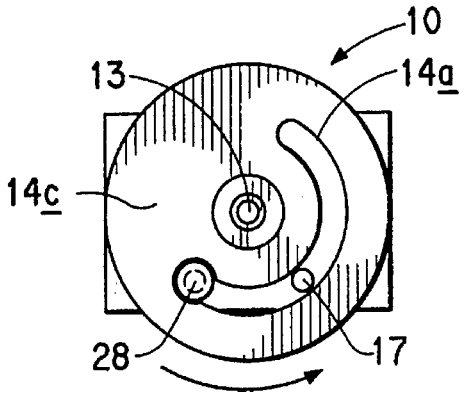
FIG. 6 is a view of FIG. 5 showing the flange rotated to slidably pass over the stop.

To remove the yarn needle 24 for inspection from the jet body 16, high pressure gas to inlet 18 is turned off, then flange 12 is rotated in the direction of the arrow as shown in FIGS. 4 and 6. When the flange is clear the head of bolt 28, it is moved axially away from the inlet end of body 16 until the yarn needle is free from the body for inspection. The venturi 22 may be removed for cleaning by pushing it upstream by the operator's finger or a probe. After cleaning and inspection, venturi is pushed back into place against plate 21, and needle 24 is reinserted back to its appropriate position. To replace the needle, the procedure is reversed. To facilitate rotational movement of the flange 12, especially while disengaging notch 12*b* from spring 30, a short peg 19 may be fitted to the side of flange 12 as shown in FIG. 4.

Figure 5:
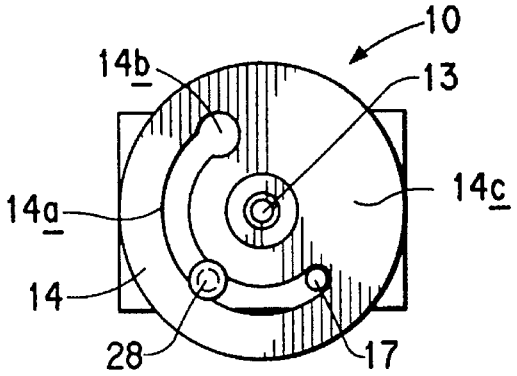
FIG. 5 is a view of FIG. 1 taken along line 5—5.

The flange 14 is an alternate embodiment of the present invention and works in a similar manner. This embodiment includes an arcuate slot 14*a* with an enlargement 14*b* at one end of the slot. The enlargement 14*b* is slightly larger than the head of bolt 28 but the width of slot 14*a* is smaller than the head of bolt 28. Bolt 28 threads into the body through slot 14*a* and engages surface 14*c*. A pin 17 extends out from the inlet end of the jet body and engages the slot 14*a*. When the flange is turned so that pin 17 is seated at one end of slot 14*a*, as shown in FIG. 5, the needle is rotatably in operating position. The pin engaging the slot at one end serves the same purpose as the spring 30 engaging notch 12*b* in the embodiment shown in FIGS. 1–4.

To remove the yarn needle for inspection, air is cut off and the flange 14, is moved axially inward, and rotated in the direction of the arrow until the enlargement 14*b* is reached at the head of bolt 28. Then the yarn needle and flange are moved axially outward past the bolt 28.

In the above description, the setting of bolt 28 dictates the gap distance between needle tip 9 and inlet side of venturi 22. As long as bolt 28 is not moved in or out of its threaded hole, the gap distance remains fixed and unchanged. Even when the needle is taken out of body 16, for inspection and replacement, the gap distance is undisturbed for consistent texturing quality.

Unlike the prior art, when the mill decides on texturing different yarn denier which requires different gap distance between needle and venturi, the texturizer does not need to buy different jet with different gap distance. The texturizer simply adjusts bolt 28 in its threaded hole in or out and resets gap distance between needle and venturi to the new required texturing condition. Then the new gap condition remains undisturbed, even if the needle is taken out, as described in the present invention. It is sometimes advantageous, but not essential to have bolt 28 locked in its predetermined position for a specific gap setting. Means to do so can be accomplished by a suitably located set screw 28*a* in jet body 16 (FIG. 1) which frictionally presses against the threaded portion of bolt 28, preventing it from moving in or out of preset position.

What is claimed is:

1. In a yarn texturing jet that includes a hollow body member forming a chamber, means for introducing fluid under pressure into said chamber, an exit nozzle from the chamber for fluid and yarn, and a yarn guiding member axially slidable in the body member extending through the chamber for supplying yarn to the nozzle for texturing, said yarn guiding member being mounted on said body member for movement from an operating position to a string-up position closer to the exit nozzle and for movement back to an operating position and means for stopping movement of the yarn guiding member at an appropriate operating position, the improvement comprising: a spring attached to the body member; a flange located outside said body member, said flange being attached to said yarn guiding member, said flange engaging said means for stopping slidable movement of the yarn guiding member in the operating position, and being rotatable free from engagement with said means for stopping slidable movement of the yarn guiding member to permit said yarn guiding member to be removed from said body member for examination without disturbing said means for stopping said yarn guiding member, said flange having a notch engaging said spring to provide rotational positioning of said yarn guiding member.

2. The jet of claim 1, wherein means for stopping slidable movement of the yarn guiding member is an adjustable stop member set to appropriate operating conditions for different yarns.

3. The jet of claims 1 or 2, wherein said means for stopping slidable movement of the yarn guiding member is lockable at said appropriate operating positions.

4. The jet of claim 1 including a baffle adjacent the exit nozzle.

* * * * *